US006217985B1

(12) United States Patent
Hirukawa et al.

(10) Patent No.: US 6,217,985 B1
(45) Date of Patent: Apr. 17, 2001

(54) TRANSFER PRINTING FILM AND GOLF BALL MARKED BY THE SAME

(75) Inventors: Masaru Hirukawa, Kyoto; Ryuhei Kametani, Osaka; Susumu Muta; Takashi Ohira, both of Chichibu, all of (JP)

(73) Assignees: Kabushiki Kaisha Showa Ink Kogyosho, Kyoto-fu; Kametani Sangyo Kabushiki Kaisha, Osaka-fu; Bridgestone Sports Co., Ltd., Tokyo, all of (JP)

( * ) Notice: Subject to any disclaimer, the term of this patent is extended or adjusted under 35 U.S.C. 154(b) by 0 days.

(21) Appl. No.: 09/168,345

(22) Filed: Oct. 7, 1998

Related U.S. Application Data

(63) Continuation-in-part of application No. 08/917,741, filed on Aug. 27, 1997, now abandoned.

(30) Foreign Application Priority Data

Oct. 7, 1997 (JP) ..... 9-291703

(51) Int. Cl.[7] ..... B41M 5/26

(52) U.S. Cl. ..... 428/195; 428/413; 428/423.1; 428/480; 428/913; 428/914; 473/351; 473/371

(58) Field of Search ..... 428/195, 423.1, 428/480, 913, 914, 413, 206; 473/351, 371

(56) References Cited

U.S. PATENT DOCUMENTS 5,697,715 * 12/1997 Kuroda et al. ..... 400/237

FOREIGN PATENT DOCUMENTS 58-183285 * 10/1983 (JP) ..... 428/195

* cited by examiner

*Primary Examiner*—Bruce H. Hess
(74) *Attorney, Agent, or Firm*—Sughrue, Mion, Zinn, Macpeak & Seas, PLLC

(57) ABSTRACT

The invention provides a transfer printing film, an ink layer of which comprises a urethane resin having a predetermined hydroxyl value and a polyester resin and/or an epoxy resin having an another predetermined hydroxyl value, and provides a golf ball marked by the film.

The hydroxyl-functional urethane resin and polyester resin and/or epoxy resin in the ink layer react with isocyanate functional resins in the urethane clear top coat of a golf ball to form urethane bondings respectively, whereby the strong adhesion between the urethane clear top coat and the ink layer is realised, and the transferred pattern becomes to be hardly removed from the golf ball surface and to be superior in hitting durability.

Furthermore, because not only the urethane resin but also the polyester resin and/or epoxy resin is incorporated in the ink layer, a transfer temperature of the ink layer as a whole becomes low, and thus, in the operation of thermal transfer of the pattern, the heat damage of distortion of dimples, golf ball, and the pattern are respectively decreased as well as the required thermal energy being lowered.

6 Claims, No Drawings

TRANSFER PRINTING FILM AND GOLF BALL MARKED BY THE SAME

This is a continuation-in-part application of now abandoned Ser. No. 08/917,741 filed Aug. 27, 1997.

FIELD OF THE INVENTION

The present invention relates to a transfer printing film and a golf ball marked by the same. More particularly, it relates to a transfer printing film capable of thermally printing patterns on golf balls at a relatively low temperature and a golf ball marked by the same.

BACKGROUND OF THE INVENTION

A transfer printing film for transfer printing patterns comprising any combination of logo, words, numbers, etc. on pattern receive surfaces, such as surfaces of plastic articles and the like, generally includes a strip-shaped substrate film and an ink layer disposed on one side of the substrate film so as to form the pattern by means of gravure or screen printing. In the operation of applying pattern to article, the transfer printing film is so placed that the pattern thereof is positioned in a predetermined printing area of a surface of the article, and the film is sandwiched between a thermal pad and the article under a certain pressure, whereby the heated ink layer is transferred from the substrate film to the article.

In case of printing patterns on golf balls, taking into consideration how they are used, it is particularly desired that transferred ink layer is hardly removed.

Generally, the golf balls are, after the pattern is printed, subjected to urethane finish, which is substantially carried out by spraying a two-component urethane paint or two-pack urethane paint, to form a clear top coat covering the golf ball and the printed pattern in order to improve appearance of them as well as to protect them from dirt, scratch, etc. However, when an adhesion between the urethane layer of the finish coat and the ink layer of the printed pattern is weak, the ink layer tends to be easily removed.

In order to enhance the adhesion between the two layers, a transfer printing film is disclosed in Japanese Unexamined Patent Publication No.89214/95, that a urethane resin having a desired hydroxyl value is incorporated in the ink. Accordingly, when spraying the two-component urethane paint to the golf ball, the hydroxyl-functional urethane resin in the ink layer, which has been already transferred to the surface of the golf ball, reacts with the isocyanate functional resins existing in one of the two components of the paint to form urethane bondings. As a result strong chemical cross links and adhesion between the urethane finish layer and the ink layer are realised.

On the other hand, it is known to the art that a lower transfer temperature is preferable because a higher one costs more thermal energy as well as it may give rise to a heat damage of the article, the damage of distortion of dimples or golf ball itself in case the article is a golf ball, for example. The higher transfer temperature may also tend to cause a shrinkage of the substrate film consisting of synthetic resin such as polypropylene and the like, and the shrinkage of the substrate film further causes a crease or a distortion of pattern transferred to the surface of article. In this aspect, the transfer printing film according to the above-mentioned Patent Publication has a drawback that it is likely to need essentially a higher transfer temperature, for the ink layer of which comprises as a main vehicle urethane resin whose softening temperature is relatively high. In fact, the Publication teaches that the transfer temperature required in the operation using the above transfer printing film is about 130° C.

SUMMARY OF THE INVENTION

Consequently, it is an object of the present invention to provide a transfer printing film capable of printing a pattern, which is hardly removed from the article and superior in hitting durability, at a lower transfer temperature, and to provide a golf ball marked by the transfer printing film.

The above and other objects, features and advantages of the present invention will become apparent to those skilled in the art from the following description of the invention.

The present invention is, accordingly, directed to a transfer printing film which comprises a urethane resin having a predetermined hydroxyl value, and a polyester resin and/or an epoxy resin having an another predetermined hydroxyl value in its ink layer.

The present invention is further directed to a golf ball which has been marked with an ink layer comprising a urethane resin having a predetermined hydroxyl value, and a polyester resin and/or an epoxy resin having an another predetermined hydroxyl value.

The ink layer disposed on one side of the substrate film of the transfer printing film according to the present invention has not only a urethane resin but also a polyester resin and/or an epoxy resin. Because a softening temperature of a polyester resin and epoxy resin is lower than that of urethane resin, a transfer temperature of the ink layer as a whole becomes low, and thus, the heat damage of distortion of dimples, golf ball, and the pattern are respectively decreased as well as the required thermal energy being lowered.

Furthermore, because not only the urethane resin but also the polyester resin and/or epoxy resin has a hydroxyl value, when spraying the two-component urethane paint, the hydroxyl-functional urethane resin and polyester resin and/or epoxy resin in the ink layer on the golf ball surface reacts respectively with the isocyanate functional resins existing in the sprayed paint so as to form respectively urethane bondings. Consequently, the strong adhesion between the urethane clear top coat layer and the ink layer are realised, and the transferred pattern becomes to be hardly removed from the golf ball surface and to be superior in hitting durability.

BEST MODE FOR CARRYING OUT THE INVENTION

The substrate film used in preparation of the transfer printing film of the present invention may be a conventional film used as the substrate film, such as a biaxially oriented or a non-oriented polypropylene film, a laminated film composed of polypropylene film and a glassine, and the like.

Applying method for the ink layer onto the substrate film used in preparation of the transfer printing film of the present invention may be a conventional printing method, such as gravure printing or screen printing method.

The hydroxyl value of the urethane resin is controlled as small as possible including null, preferably less than 0.2.

The hydroxyl value of the urethane resin of over 0.2 may give rise to a remarkable increase of the transfer temperature of the ink due to an intermolecular power of hydrogen bond.

The hydroxyl value of the urethane resin may be null because, as described hereinafter, the hydroxyl value of the polyester resin and/or epoxy resin, which is incorporated in the ink layer together with the urethane resin, is high enough to form sufficient urethane bondings between the urethane finish layer and the ink layer.

On the contrary, the hydroxyl value of the polyester resin and/or epoxy resin is so controlled that sufficient urethane bondings are formed between the urethane finish layer and the ink layer to realise the strong adhesion, preferably 60 to 250.

The hydroxyl value of the polyester resin and/or epoxy resin of less than 60 may give rise to a decrease of the adhesion between the two layers, and the hydroxyl value of the polyester resin and/or epoxy resin of over 250 may give rise to a remarkable increase of the transfer temperature of the ink due to the intermolecular power of hydrogen bond. The hydroxyl value of the polyester resin and/or epoxy resin is more preferably 140 to 210.

The ink layer of the transfer printing film of the present invention may further comprise a polyethyleneimine resin. The polyethyleneimine resin enhances an adhesion between the ink layer and the surface of the article including golf ball.

The typical composition of these resins in the ink layer is, for example, 100 parts by weight of the urethane resin, 5 to 10 parts by weight of the polyester resin and/or epoxy resin, and 0.5 to 2.0 parts by weight of the polyethyleneimine resin.

The polyester resin and/or epoxy resin of less than 5 parts by weight may give rise to an increase of the transfer temperature of the ink layer and lead to a poor adhesion between the ink layer and the urethane finish layer.

On the contrary, the polyester resin and/or epoxy resin of over 10 parts by weight may give rise to a decrease of a hardness of the ink layer.

On the other hand, the polyethyleneimine resin of less than 0.5 parts by weight may give rise to a decrease of the adhesion between the ink layer and the surface of the article including a golf ball.

The polyethyleneimine resin of over 2.0 parts by weight may not be worthy to add.

A golf ball of the present invention has been marked with an ink layer having the above-mentioned components. Therefore, the ink layer of the golf ball has an excellent adherability to urethane layer of the top coat, and a durability of the transferred mark becomes higher. A thermal transfer of the pattern can be carried out at a relatively low temperature, such as between 90° C. and 120° C., whereby a heat deformation of the dimples can be effectively avoided.

The golf ball of the present invention may be any kind of ball including a one-piece ball, two-piece ball, three-piece ball, other multi-layered solid golf ball, and thread-wound ball.

A cover material of the ball surface, on which the markings are applied, may be an ionomer resin, polyurethane resin, polyester resin, polyamide resin, and a mixture thereof.

The golf ball of the present invention can be pretreated before marking. Examples of such pretreatment includes known plasma treatment, chemical treatment with chlorine chemicals, and the like.

Any of marking techniques can be employed which have been commonly used in the printing operation. Examples of such marking technique includes a known pad printing technique moving a printing pad up and down relative to the article. Transfer temperature, or a temperature of a silicone pad surface, which contacts a transfer printing film, may range between 90° C. and 150° C., preferably between 90° C. and 20° C. Transfer period of time is preferably within two seconds.

After marking, the golf ball of the present invention is covered by a clear coat using a two- component urethane paint. Applying technique is preferably a spray applying technique. Other applying techniques can also be used. As the two-component urethane paint, any of known ones can be employed.

EXAMPLES

The present invention is illustrated by the following Examples which, however, are not to be construed as limiting the present invention to their details.

Example 1

Preparation of transfer printing film

On one side of a biaxially oriented polypropylene film with micrometer thickness as a substrate film, a letter "H" (a size of 3 mm×3 mm with a thickness of 1 micrometer) was printed by means of gravure printing method with an ink prepared, as shown in Table 1, to include 100 parts by weight of a urethane resin having a hydroxyl value of 0.1, 8 parts by weight of a polyester resin having a hydroxyl value of 150, 1.2 parts by weight of a polyethyleneimine resin and 10 parts by weight of a carbon black as a pigment, whereby a transfer printing film according to the present invention was prepared (Transfer printing film A).

In the same manner as above, another transfer printing film according to the present invention were also prepared (Transfer printing films B to E).

Thermal transfer of pattern

Each of the transfer printing films was placed on a golf ball, a surface of which was a typical plasma treated ionomer resin cover, and the film was sandwiched between the golf ball and a thermal silicone pad having a temperature of 90° C. for 1 second.

Then, the golf ball was subjected to urethane finish by spraying a two-component urethane paint to form a urethane clear top coat covering the golf ball and the printed pattern.

Impact test and abrasion test

For each finished golf ball, hitting durability was evaluated by hitting the ball against a steel plate two hundred times at a speed of 140 kilometers an hour, and abrasion resistance was evaluated by milling the ball with sand for two hours. Every pattern of the letter "H" printed on each golf ball was not removed from the surface and well remained readable.

TABLE 1

| Transfer printing film | A | B | C | D | E |
|---|---|---|---|---|---|
| Urethane resin (hydroxyl value) | 100 (0.1) | 100 (0.1) | 100 (0.1) | 100 (0.1) | 100 (0.1) |
| Polyester resin (hydroxyl value) | 8 (150) | 5 (66) | 10 (250) | — | 4 (150) |
| Epoxy resin (hydroxyl value) | — | — | — | 8 (200) | 4 (200) |
| Polyethyleneimine resin | 1.2 | 0.5 | 2.0 | 1.2 | 1.2 |
| Carbon black | 10 | 10 | 10 | 10 | 10 |

Example 2

Preparation of golf ball

A plurality of two-piece golf balls were provided, each having a core enclosed in a cover material of 2 millimeters thick. The core was made of cross-linked synthetic rubber including polybutadiene rubber as a main component. The cover material, having a Shore D hardness of 65, was made of ionomer resin as a main component. Each ball was plasma treated on the surface like balls employed in Example 1.

Using a transfer printing film prepared in the same manner as the film E of Example 1, a letter "H" having a size of 3 mm×3 mm was transferred to each ball. Transfer temperature was 90° C., 100° C., 120° C., 130° C. or 150° C. Other transfer condition was the same as Example 1. Using a surface thermometer, a temperature of silicone pad surface, which directly contacted the transfer film, was measured as the transfer temperature.

Evaluation of transferability and adherability

At this stage, it was evaluated by a visual observation whether the mark of the letter was completely transferred to the ball surface. In order to assess an adherability of the mark, a peel test was carried out using an adhesive tape commercially available from Sumitomo 3M Co., Ltd, Tokyo, Japan. The results are all shown in Table 2. Table 2 shows, for the transferability, a number of balls out of twenty, to which some portions of the mark were untransferred. In Table 2, as for the adherability, a symbol "○" stands for no peel off, a symbol "Δ" a little peel off, a symbol "□" a partly peel off, and a symbol "x" almost peel off.

On the thus marked golf balls, the same two-component reactive clear urethane paint as employed in Example 1 was spray coated, and a wetting condition on the mark was observed to assess an affinity.

Evaluation of durability

Thereafter, the resulting golf balls were examined by the following tests to assess durability of the marks.

(a) Impact test

The ball was hit 200 times repeatedly by #1 wood with a club head velocity of 45 meters per second toward a fabric-made target. The degree of damage on the mark was evaluated by visual observation.

(b) Sand abrasion test

The ball was put in a porcelain ball mill with sand used for bunker in a golf course, and the resultant mixture was stirred for two hours. The degree of damage on the mark was evaluated by visual observation.

(c) Sand/water abrasion test

The ball was put in a porcelain ball mill with sand used for bunker in a golf course and water in equal amount of the sand, and the resultant mixture was stirred for three hours. The degree of damage on the mark was evaluated by visual observation.

The results are all shown in Table 3. In Table 3, a symbol "○" stands for no damage or no chipping and a symbol "×" damage or chipping.

Comparative Example

As a comparison, a transfer printing film was prepared, with using the same substrate film as in Example 1 and an ink composition including 100 parts by weight of a urethane resin having a hydroxyl value of 3, and 10 parts by weight of a carbon black. A plurality of the same golf balls as in Example 2 were marked by the thus prepared transfer printing film in the same manner as in Example 2. Thereafter, the resulting golf balls were subjected to the same tests as in Example 2. The results are also shown in Tables 2 and 3.

TABLE 2

| | Example 2 | | | | | Comparative Example | | | | |
|---|---|---|---|---|---|---|---|---|---|---|
| Transfer temperature (° C.) | 150 | 130 | 120 | 100 | 90 | 150 | 130 | 120 | 100 | 90 |
| Transferability | 0/20 | 0/20 | 0/20 | 0/20 | 1/20 | 0/20 | 0/20 | 6/20 | 10/20 | 10/20 |
| Adherability | ○ | ○ | ○ | Δ | □ | Δ | □ | □ | X | X |

TABLE 3

| | Example 2 | | | | | Comparative Example | | | | |
|---|---|---|---|---|---|---|---|---|---|---|
| Transfer temperature (° C.) | 150 | 130 | 120 | 100 | 90 | 150 | 130 | 120 | 100 | 90 |
| Impact test | ○ | ○ | ○ | ○ | ○ | ○ | ○ | ○ | X | X |
| Sand abrasion test | ○ | ○ | ○ | ○ | ○ | ○ | ○ | ○ | X | X |
| Sand/water abrasion test | ○ | ○ | ○ | ○ | ○ | ○ | ○ | X | X | X |

As clearly understood from Table 2, the ink according to Example 2 is found to be superior in transferability and adherability, and can be transferred at a lower temperature.

A clear deformation of dimples was observed when the transfer temperature was 150° C., and a little deformation when 130° C. However, no deformation of dimples was observed when the transfer temperature was 120° C., 100° C. and 90° C. Therefore, the ink according to the Example, which is transferable under a lower temperature, has an advantage from a viewpoint of dimple deformation.

As for the wetting of sprayed urethane paint on the mark, no shedding was observed in both Example 2 and Comparative Example.

As clearly understood from Table 3, every golf ball according to Example 2 shows satisfactory results in all durability tests. In particular, when marking was carried out under a lower temperature, golf balls in Example 2 are found to be superior in durability to those in the Comparative Example.

There has been described a transfer printing film having an ink layer comprising a polyester resin, an epoxy resin or a mixture thereof on a substrate film. Because these resins possess a lower softening temperature and lower melting point, a softening temperature of the ink layer as a whole becomes low, and thus, the pattern defined by the ink layer can be printed under a lower transfer temperature. Therefore, the heat damage of distortion or deformation of the pattern receive articles are decresed, the shrinkage of the sabstrate film can be avoided, and the required energy cost is lowered. Furthermore, because both polyester resin and epoxy resin are also accorded a sufficient hydroxyl value, the ink layer and sprayed two-component urethane paint react each other to form additional urethane bondings, whereby the pattern becomes to be hardly removed, peeled off, or chipped from the article surface. Thus, the golf ball of the present invention, which is marked by the above transfer printing film, is free from a heat deformation of dimples maintaining an original designed shape thereof, whereby the golf ball preserves a contemplated flying character satisfactorily.

Although some preferred embodiments have been described, many modifications and variations may be made thereto in the light of the above teachings. It is therefore to be understood that within the scope of the appended claims, the invention may be practiced otherwise than as specifically described.

Having thus described the invention, it is claimed:

1. A transfer printing film having a substrate film and an ink layer disposed on one side of the substrate film and printed to form a predetermined pattern to be transferred, said ink layer comprising:

a urethane resin having a hydroxyl value less than 0.2, and a polyester resin and/or an epoxy resin having a hydroxyl value in the range of 60 to 250.

2. The transfer printing film according to claim 1, said ink layer further comprising a polyethyleneimine resin.

3. A golf ball marked by the transfer printing film of claim 1.

4. A transfer printing film having a substrate film and an ink layer disposed on one side of the substrate film and printed to form a predetermined pattern to be transferred, said ink layer comprising:

100 parts by weight of urethane resin having a hydroxyl value less than 0.2, 5 to 10 parts by weight of a polyester resin and/or an epoxy resin having a hydroxyl value not less than 60 and not more than 250, and 0.5 to 2.0 parts by weight of a polyethyleneimine resin.

5. A golf ball marked by a transfer printing film having a substrate film and an ink layer disposed on one side of the substrate film and printed to form a predetermined pattern to be transferred, said ink layer comprising:

a urethane resin having a hydroxyl value less than 0.2, a polyester resin and/or an epoxy resin having a hydroxyl value not less than 60 and not more than 250, and a polyethyleneimine resin.

6. A golf ball marked by a transfer printing film having a substrate film and an ink layer disposed on one side of the substrate film and printed to form a predetermined pattern to be transferred, said ink layer comprising:

100 parts by weight of urethane resin having a hydroxyl value less than 0.2, 5 to 10 parts by weight of a polyester resin and/or epoxy resin having a hydroxyl value not less than 60 and no more than 250, and 0.5 to 2.0 parts by weight of a polyethyleneimine resin.

* * * * *